US006805072B1

(12) United States Patent
DeSano

(10) Patent No.: US 6,805,072 B1
(45) Date of Patent: Oct. 19, 2004

(54) CONTAINER TIME INDICATOR

(76) Inventor: Anthony S DeSano, 3300 Second St., Oceanside, NY (US) 11572

( * ) Notice: Subject to any disclaimer, the term of this patent is extended or adjusted under 35 U.S.C. 154(b) by 0 days.

(21) Appl. No.: 10/369,470

(22) Filed: Feb. 20, 2003

(51) Int. Cl.[7] ..... G09F 11/04
(52) U.S. Cl. ..... 116/308; 116/309
(58) Field of Search ..... 206/459.1, 459.5; 215/230, 228, 365; 40/310, 311; 116/308, 309, 311, 316, 317, 318

(56) References Cited

U.S. PATENT DOCUMENTS 2,111,637 A * 3/1938 Mehaffey ..... 116/308
2,528,259 A * 10/1950 Annunziata ..... 116/308
2,538,684 A * 1/1951 Gushard et al. ..... 215/382
3,139,064 A * 6/1964 Harle ..... 116/309
3,460,508 A * 8/1969 Baxter ..... 116/317
3,700,095 A * 10/1972 Dangles et al. ..... 206/534
3,782,577 A * 1/1974 Levey ..... 215/206
4,207,982 A * 6/1980 Maxwell et al. ..... 206/534
5,400,907 A * 3/1995 Chen ..... 206/459.1
5,433,324 A * 7/1995 Leonard ..... 206/534
5,644,298 A * 7/1997 Brooks et al. ..... 340/612
5,662,224 A * 9/1997 Nogues ..... 206/534
5,839,581 A * 11/1998 Vagedes ..... 206/459.1

* cited by examiner

*Primary Examiner*—Christopher W. Fulton
*Assistant Examiner*—R. Alexander Smith
(74) *Attorney, Agent, or Firm*—Michael I Kroll

(57) ABSTRACT

The present invention 10 discloses a container 14 having a stationary ring 16 and a rotative ring 18 disposed near the top portion of a bottle. The stationary ring 16 is labeled incrementally with time periods, such as hours, with smaller increments indicative of shorter time positioned therebetween. The rotative ring 18 has similar time indications with an arrow 24 at the zero or start time. The rotative ring 18 being indicative of a start time is moved until the arrow aligns with the actual time that the container 14 was filled. When a user 12 wishes to determine the length of time expired since the container 14 was filled, the user obtains the actual time from a watch or clock and refers to a position on the stationary ring 16 correlating to the obtained time whereupon reference is made to the rotative ring 18 at the point opposing the stationary ring 16 which discloses an elapsed time period since the container's 14 contents were prepared. Several embodiments of the present invention 10 are disclosed.

4 Claims, 14 Drawing Sheets

CONTAINER TIME INDICATOR

BACKGROUND OF THE INVENTION

1. Field of the Invention

The present invention relates generally to indicator devices and, more specifically, to means for indicating the time a substance was prepared and containerized or a container was opened.

The timer can be provided in a number of variations as herein disclosed. A container having a stationary ring and a rotative ring. The stationary ring is labeled incrementally with time periods, such as hours, with smaller increments indicative of shorter time positioned therebetween. The rotative ring has similar time indications with an arrow at the zero or start time. The rotative ring indicative of a start time is moved until the arrow aligns with the actual time that the container was filled. When a user wishes to determine the length of time expired since the container was filled, they obtain the actual time from a watch or clock and refer to a position on the stationary ring correlating to said obtained time whereupon reference made to the rotative ring at the point opposing the stationary will disclose an elapsed time period since the containers contents were prepared. It should be noted that while the rotative ring is herein described as the rotative member, the object of the present invention could easily be achieved by having the time elapsed member as the stationary ring while the clock-like time indicia is displayed on the rotative ring.

Another method of achieving the time duration is disclosed wherein the clock-like indicia or elapsed time indicia is imprinted on the container having a rotative element with the opposing indicia imprinted thereon whereby the rotative member will be moved to a selected position whereby the user can ascertain the elapsed time since the container was prepared or opened.

The present invention provides for an additional element wherein the time indicia is extended by having the days of the week displayed in addition to the hours in a day. At least one indicator graphic such as an arrow is displayed on the exterior of the container is close proximity to the days of the week and hours in the day indicia and whereupon the days of the week are displayed on a rotative member and the hours in the days are displayed on a different rotative member whereby both can be independently moved to be in alignment with the indicator graphic selectively positioned to provide the day of the week and time of day that the container contents were prepared or the container opened.

The present invention provides for another additional element in the form of a collar having an indicator graphic displayed thereon and the rotative elements forming an integral part of said collar whereby said collar can be removably mounted onto a container thereby providing the user with means of selectively aligning the rotative elements with the indicator graphic to visually display the time the container contents were prepared or the container was opened. The mountable time indicator element could also be incorporated into a lid-like device having the indicator graphic and rotative time elements forming an integral part with said lid-like device and wherein said lid-like device can incorporated a hinged element providing means for dispensing part of said container contents and means for sealing said container for later use.

2. Description of the Prior Art

There are other time indicating device designed for control aids. Typical of these is U.S. Pat. No. 2,450,949 issued to Gattuccio, et al. on Oct. 12, 1948.

Another patent was issued to North on Apr. 19, 1955 as U.S. Pat. No. 2,706,464. Yet another U.S. Pat. No. 3,766,882 was issued to Babbitt, III on Oct. 23, 1973 and still yet another was issued on Jun. 25, 1974 to Kramer et al. as U.S. Pat. No. 3,818,858.

Another patent was issued to Hopkins et al. on Jul. 26, 1977 as U.S. Pat. No. 4,037,559. Yet another U.S. Pat. No. 4,345,541 was issued to Villa-Real on Aug. 24, 1982. Another was issued to Hevoyan on Oct. 22, 1985 as U.S. Pat. No. 4,548,157 and still yet another was issued on Aug. 29, 1989 to Al-Harbi as U.S. Pat. No. 4,860,684.

Another patent was issued to Hoffman on Jan. 9, 1996 as U.S. Pat. No. 5,482,163. Yet another U.S. Pat. No. 5,896,990 was issued to Barzana on Apr. 27, 1999. Another was issued to Telega on May 30, 2000 as U.S. Pat. No. 6,068,149 and still yet another was issued on Jul. 18, 2000 to Nichols, Jr. as U.S. Pat. No. 6,089,180.

U.S. Pat. No. 2,450,949

Inventor: Salvatore Gattuccio

Issued: Oct. 12, 1948

A bottle cap comprising an internally threaded sleeve having an integral closure plate at one end, an annular channel provided in the outer surface of the closure plate having opposed annular substantially vertical bearing surface, an internally toothed ring gear rotatably mounted in said channel having an upper annular edge and a lower annular edge for engaging the horizontal bearing surfaces of the channel.

U.S. Pat. No. 2,706,464

Inventor: Harold D. North

Issued: Apr. 19, 1955

A two-piece container for medicinal capsules, pills or the like provided with dose-time indicating means, and comprising a molded plastic substantially non-yielding cylindrical body member having a substantially uniform cylindrical interior and a reduced cap receiving neck portion extending a substantial distance from the open end of the body and having thereon uniformly spaced ribs and grooves corresponding to divisions of twelve-hours, the ribs and grooves being slightly tapered with respect to the axis of the body, and a closure member having interfitting correspondingly tapered and spaced ribs and grooves and adapted to be frictionally held in any selected angular position when pressed longitudinally upon the body, and the container and closure having coacting graduations and numerals and an indicating pointer imprinted upon the exterior of the surfaces of the body closure.

U.S. Pat. No. 3.766.882

Inventor: Dean R. Babbitt, III

Issued: Oct. 23, 1973

This specification discloses a conventional container from which doses of pills are intended to be taken from time to time, and which container includes a main body portion and a cap removably secured on the main body portion by a snap action fastening device. About the open end of the main body portion is a scale indicating hours and inscribed on the cap is a line wich cooperates with this scale. A foam plastic pad is secured to the underside of the cap and cooperates with the upper end of the main body portion to hold the cap in an angularly adjusted position thereon.

U.S. Pat. No. 3,818,858

Inventor: Howard J. Kramer, et al.

Issued: Jun. 25, 1974

A food storage container which in a preferred embodiment includes a lid with a downwardly extending outer flange of annular shape mountable on a vessel having a round mouth with substantially upright walls, the outer surface of the annular flange having a series of evenly spaced markers designating each a particular day of the week, and the outer upright wall's outer surface extending annularly around the vessel having a series of time-period-interval indications such as typically and preferably the 31 days of the longest months of the year, with the spaces between the days of the week on the lid flange being of a predetermined dimension such that solely one day of the week mark is alignable with any of the one through thirty-one days of the month on the vessel wall, i.e. at any one time it being impossible for more than one of the respective days of the week being aligned with different ones of the thirty-one days of the month, whereby it is possible always to precisely align a specific day with a specific date without the possibility of confusion insofar as other days being aligned with other dates.

U.S. Pat. No. 4.037.559

Inventor: John Leslie Hopkins, et al.

Issued: Jul. 26, 1977

An indicator device for use in connection with milk bottles as a means of indicating a requirement therfor consists of two telescopingly and separably engaged conical members rotably supported one upon another, and co-operating scale and pointer means on the respective parts adapted, according to a relative angular disposition, to indicate a selected one of a plurality of legends which constitute the scale.

U.S. Pat. No. 4,345,541

Inventor: Antony-Euclid C. Villa-Real

Issued: Aug. 24, 1982

A simple mechanically-manipulatable, two-component inter-acting device for use as an effective medication-time-intake reminder having an attachable-detachable outer rotatory ring with either a singular or a plurality of outer protrusions for easy clockwise turning purposes in relation to a correspondingly engageable stationary component having a flat circularly running clocklike numeral indicia that are equally interspaced between each succeeding numerals ranging from 1 to 12 is disclosed. Each respective rotatory ring has fixed clockwise spacing interval between the "LAST DOSE" arrow indicia and the "NEXT DOSE" arrow indicia depending upon the required application to accomplish the specific time interval in the administration of each corresponding particular medication. For functional effectivity it is preferred that each kind of rotatory ring for each respective time-interval application be differentially color-coded to easily distinguish one from the others.

U.S. Pat. No. 4.548,157

Inventor: Varoujan H. Hevoyan

Issued: Oct. 22, 1985

A time reminder device in a sanitary combination with a container for dispensing content in the form of pills or liquids, with or without a nipple projecting therethrough, and adjustable to a time index associated with a ring member snapped onto a cap or coupling and rotably positioned by a detent.

U.S. Pat. No. 4,860.684

Inventor: Tarik S. Al-Harbi

Issued: Aug. 29, 1989

An infant bottle timer apparatus is set forth where an encircling indexed band is fixedly securable to an associated exterior surface of a baby bottle-type feeding implement. The timer apparatus includes a lowermost portion indexed consistent with the hours of the day and a pointer selectively manipulatable within an overlying integrally formed track for indication of a subsequent feeding timing event. The track includes a channel capturing a leaf spring. The leaf spring is secured to and cooperates with the pointer which is of a generally "H" shaped cross-sectional configuration. A first pair of legs of the "H" shaped pointer is ridable within the channel and frictionally securable within the channel in cooperation with the leaf spring. A further pair of legs of the "H" shaped pointer are oriented exteriorly of the channel for indication of a subsequent feeding event in cooperation with the indicator band. The indicator band is formed as an extension of a rear portion of the channel for providing a unitary compact structure in cooperative association with the baby bottle.

U.S. Pat. No. 5.482,163

Inventor: Kenneth L. Hoffmann

Issued; Jan. 9, 1996

A last event indicator apparatus includes a cylindrical support having a longitudinal Axis, an outer surface and a tapered flange structure. The tapered flange structure has a first end having a first diameter and a second end having a second diameter that is greater than the first diameter of the first end. An expandable indicator ring is disposed over the outer surface. The indicator ring is axially displaceable along the longitudinal axis to engage the tapered flange structure and cause expansion of the indicator ring. The expandable indicator ring is rotable about the longitudinal axis over the outer surface to each of a plurality of selected positions.

U.S. Pat. No. 5.896.990

Inventor: Ramon Barzana

Issued: Apr. 27, 1999

A container assembly is provided for use in monitoring consumption of a liquid from the container assembly. The container assembly includes a body constructed and arranged to hold a liquid. The body has a base portion and an opposing top portion. The top portion permits liquid to be supplied into and to be removed from the body. The base portion has a skirt member. Indicator structure is operatively associated with the skirt member for rotational motion relative to the body into a plurality of different positions. Indicia is disposed on the body to indicate consumptive uses of the container assembly. Complementary engaging structure is on the skirt member and on the indicator structure for mounting the indicator structure with respect to the skirt member in such a manner that rotation of the indicator structure is possible in one direction and rotation of the indicator structure is resisted in the opposite direction. The engaging structure including at least one protrusion on one of the indicator structure and the skirt member and a series of spaced recesses in the other of the indicator structure and the skirt member. Each of the recesses corresponds to a particular indicia, allowing the user, with each consumptive use, to rotate the indicator structure with respect to the body in the one direction to engage the at least one protrusion with a recess, thereby monitoring consumptive uses of the container assembly.

U.S. Pat. No. 6,068,149

Inventor: Janice S. Telega

Issued: May 30, 2000

A calendaring cap for a pharmaceutical container comprising at least one ring frictionally and rotatably engaged with a cap. The cap comprises a cap bore having either a cap female thread or a cap bore lip, whereby the calendaring cap for a pharmaceutical container may be installed on a standard pharmaceutical container. Each ring bears a pointer which points towards indicia on the cap. In a calendaring cap for a pharmaceutical container embodiment incorporating two rings, the cap may bear day indicia and hour indicia. A first ring is associated with the day indicia, and its pointer points towards the day indicia. A second ring is associated with the hour indicia, and its pointer points towards the hour indicia. Thus a patient may use the day and hour indicia in conjunction with the pointers to specify when the last dose of medicine within a pharmaceutical container upon which the calendaring cap for a pharmaceutical container is installed was taken, or, in the alternative, when the next dose is due to be taken.

U.S. Pat. No. 6089,180

Inventor: Earnest Nichols, Jr.

Issued: Jul. 18, 2000

A method and apparatus for providing a multi-time indicating container, closure, and pill cup separator, comprising a common post manufactured container, with a round upper portion such as a round neck or a round body. The container further comprises a newly added rotatable pointer which is attached around the upper round portion of the container. The pointer can be attached to any post manufactured container with an upper round portion. The container further includes indicia which is applied around the upper portion of the container just below the rotatable pointer. The container further includes a post manufactured, separable double closure, which is separated using a double closure separator comprising a locking C-clamp having one standard round clamping tip and one newly added separator wedge blade tip. Separation of the closures allows time indicating indicia to be applied to the inner threaded closure side wall and enables installation of a view hole in the outer closure side wall, prior to rejoining the closures. A post manufactured independent miniature pill cup separator includes thin annular rim adapted to rest on the rim of the main container, and a closure-less pill cup separator body extending from the annular rim and disposed inside the container body. The pill cup separator is a top-less secondary container, and is sealed when the threaded inner closure is joined to the container body. The pill cup separator is used to separate a predetermined number of dosages from the main supply of pill dosages.

While these timing indicators may be suitable for the purposes for which they were designed, they would not be as suitable for the purposes of the present invention, as hereinafter described.

SUMMARY OF THE PRESENT INVENTION

The present invention discloses a container having a stationary ring and a rotative ring disposed near the top portion of a bottle. The stationary ring is labeled incrementally with time periods, such as hours, with smaller increments indicative of shorter time positioned therebetween. The rotative ring has similar time indications with an arrow at the zero or start time. The rotative ring being indicative of a start time is moved until the arrow aligns with the actual time that the container was filled. When a user wishes to determine the length of time expired since the container was filled, the user obtains the actual time from a watch or clock and refers to a position on the stationary ring correlating to the obtained time whereupon reference is made to the rotative ring at the point opposing the stationary ring which will disclose an elapsed time period since the container's contents were prepared. Several embodiments of the present invention are disclosed.

A primary object of the present invention is to provide a short term bottle contents aging method that can be used for short term food preparations.

Another object of the present invention is to provide a time aging method that doesn't require calculation of a time frame.

Yet another object of the present invention is to provide a time aging method for containers having a stationary ring with time divisions marked thereon.

Still yet another object of the present invention is to provide a time aging method for containers having a rotative ring having similar time division as the fixed ring with an indicator marker and ascending time divisions marked thereon.

Another object of the present invention is to provide a container having two rotative elements with time division indicia displayed thereon and an indicator graphic whereby the two rotative elements can be independently aligned with the indicator graphic to display a time as to the preparations of the contents or the opening of the container.

Yet another object of the present invention is to provide a removably mountable device having two rotative members with time division indicia displayed thereon and forming an integral part with said mountable device and having an indicator graphic whereby said mountable device can be selectively positioned on a container and said rotative elements moved to aligned with the indicator graphic to display a time that the container contents were prepared or the container opened.

Still yet another object of the present invention is to provide a time aging indicator for containers that is easy to manufacture.

Another object of the present invention is to provide a time aging indicator for the contents of a container that is easy to use.

Additional objects of the present invention will appear as the description proceeds.

The present invention overcomes the shortcomings of the prior art by providing means for indicating the age of a container substance preferably in hours by providing one or more rotative elements having time divisions displayed thereon and a fixed or stationary member having comparable time division displayed in ascending order with an indicator graphic positioned at the starting time indicating expired time whereby the expired time starting indicator graphic is in alignment with the clock-like time indicator time of container preparation or opening thereby providing means for a user to easily ascertain the elapsed time since the container contents were prepared or the container opened by correlating the actual time with the time displayed on the clock-like time indicator and viewing the elapsed time as indicated on the elapsed time element.

Additionally, the invention provides for a removably mountable device having one or more rotative elements with time divisions displayed thereon and an indicator graphic whereby the device can be removably attached to a container and the rotative elements independently and selectively positioned to be in alignment with said indicator graphic to display a time of container contents preparation or container opening.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
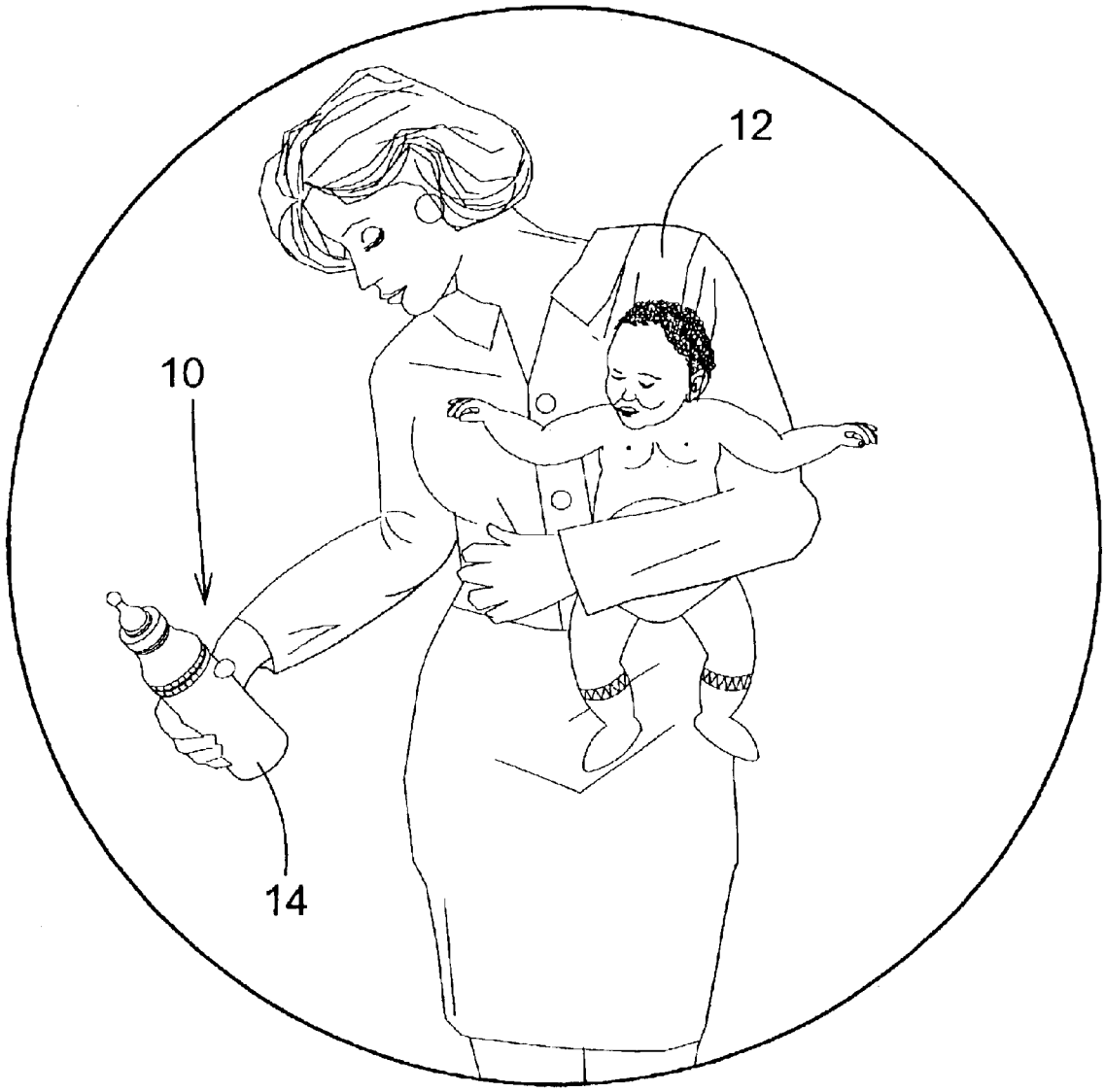
FIG. 1 is an illustrative view of the present invention in use.

With regard to reference numerals used, the following numbering is used throughout the drawings.

10 present invention
12 user
14 bottle
16 stationary ring
18 rotative ring
20 attachment ring/cap
22 indicia
24 arrow
26 track
28 nipple
30 collar
32 first ring
34 second ring
36 indicator line
38 ridges
40 ridges
42 cap
44 lid
46 pop open spout
48 lift tab

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a bottle timer having two rings positioned near the top portion of the bottle 14 wherein a first ring is stationary and is labeled incrementally with smaller increments indicative of shorter time positioned therebetween. A second ring is rotative and has time increments of similar spacing as the stationary ring. The time increment in the preferred embodiment is predetermined increments of time that are applicable to the contents within the container with an arrow assigned to the "zero" position. Once the bottle 14 is filled the rotative ring is moved until the arrow is in alignment with the actual time shown on the stationary ring. Then, making future reference to the actual time and then finding the same depicted on the stationary ring and then referring to the corresponding reading on the rotative ring indicates to a user 12 how long the contents have been in the bottle 14.

Figure 2:
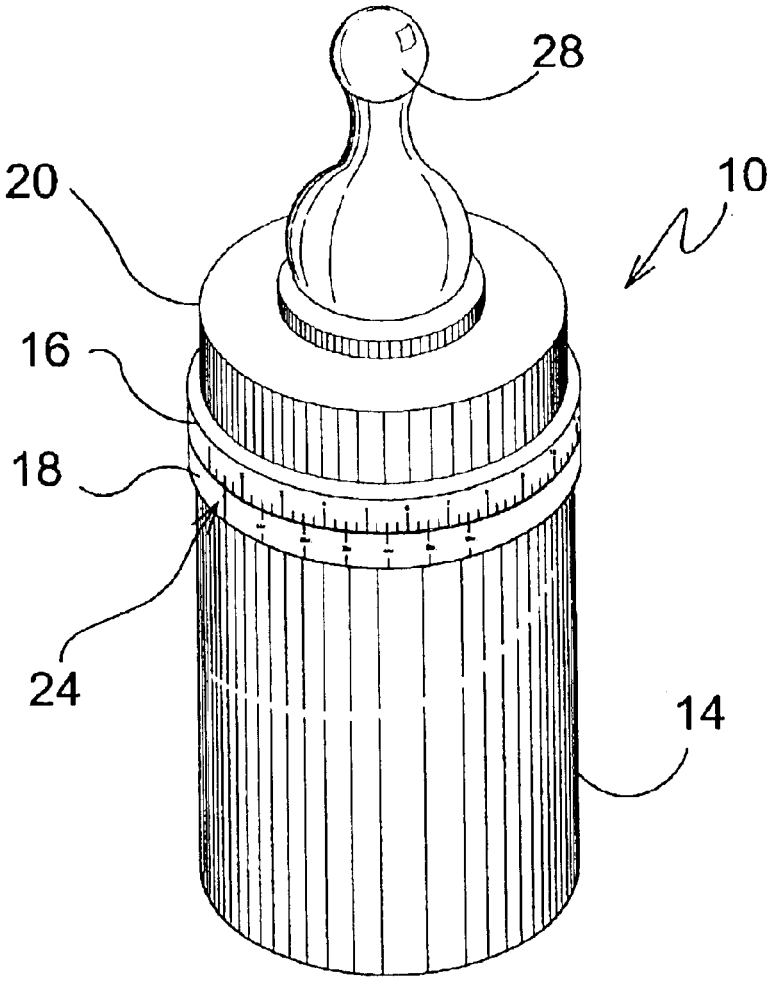
FIG. 2 is a perspective view of the present invention.

Turning to FIG. 2, shown therein is a perspective view of the present invention 10. Shown is a perspective view of the present invention 10 which discloses a bottle 14 having two rings 16, 18 positioned near the top portion of the bottle 14. The stationary ring 16 is labeled incrementally with smaller increments indicative of shorter time positioned therebetween. The rotative ring 18 has similar time indications with an arrow 24 being located at the zero or start time. The rotative ring 18 is moved until the arrow 24 aligns with the actual time that the bottle 14 was filled. When a user wishes to determine the length of time expired since the bottle 14 was filled they read the time duration displayed on the rotative ring 18 corresponding to the actual time as displayed on the stationary ring 16. A conventional attachment ring or cap 20 for use with a nipple 28 is also shown.

Figure 3:
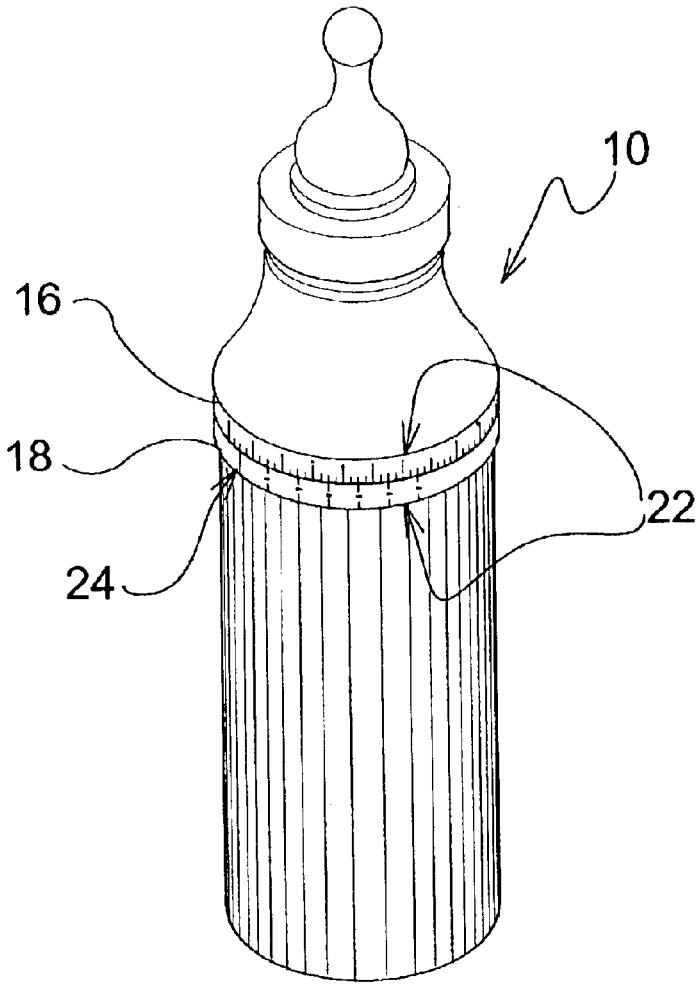
FIG. 3 is a perspective view of the present invention.

Turning to FIG. 3, shown therein is a perspective view of the present invention 10. Shown is a perspective view of the present invention 10 which discloses a standard size bottle 14 having two rings positioned near the top portion of the bottle. The stationary ring 16 is labeled incrementally with smaller increments interleaved indicative of shorter time. The adjustable ring 18 is turned so as to line up an indication arrow 24 with the time the bottle is filled. This ring 18 is labeled in increments to six hours and aligns with the time of filling on the first fixed ring 16. The positioning and function of the rings as shown is for illustrative purposes only and can be modified to perform the same purpose, such as, the rotative ring having indicia 1 to 12 or 1:00 to 12:00 at 22 while the stationary ring has time duration indicia.

Figure 4:
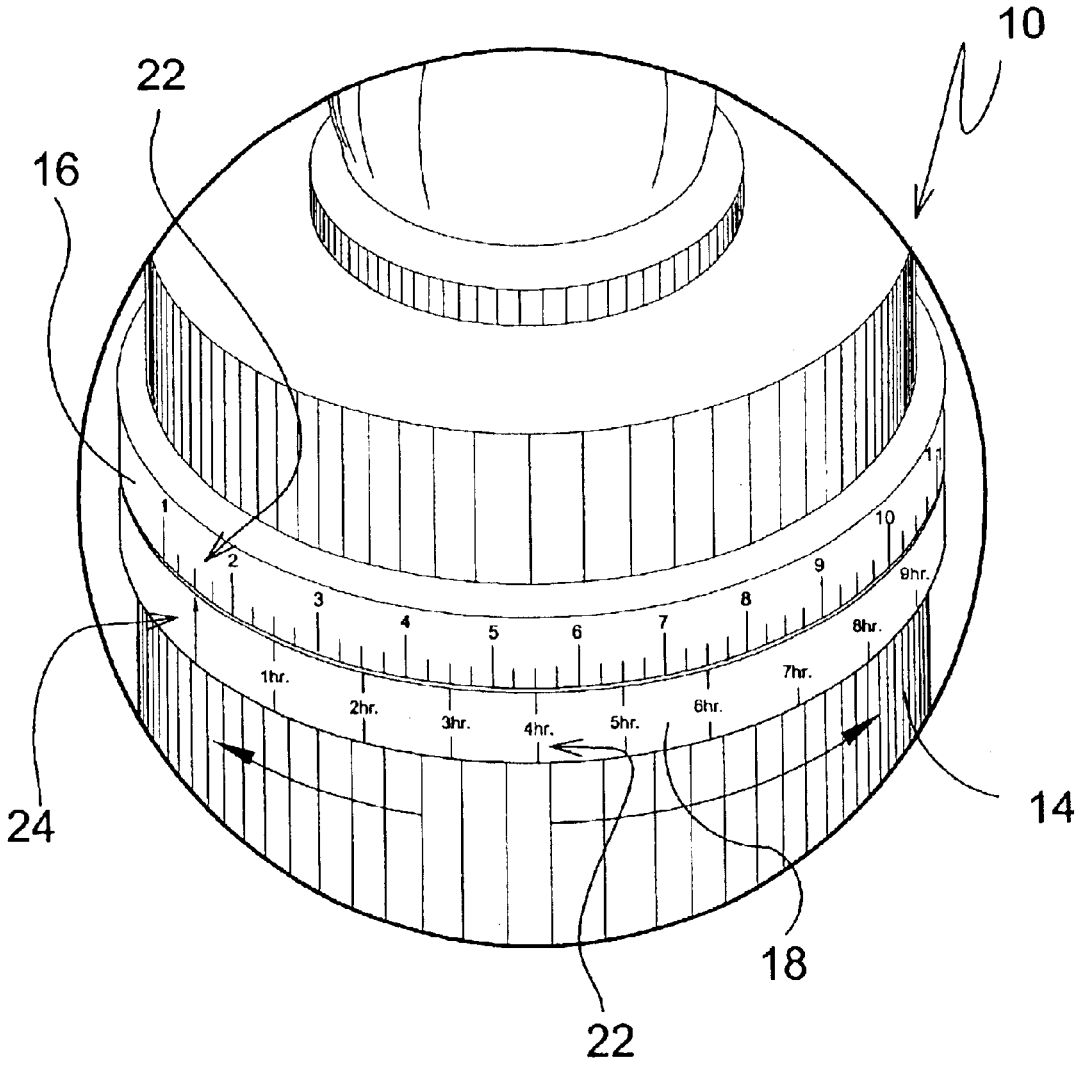
FIG. 4 is an enlarged perspective view of the present invention.

Turning to FIG. 4, shown therein is an enlarged perspective view of the present invention 10. Shown is an enlarged view of the present invention 10 which discloses a bottle 14 having two rings 16, 18 positioned near the top portion of the bottle 14. The stationary ring 16 is labeled in predetermined increments of time that are applicable to the contents of the container, with smaller increments interleaved indicative of shorter time. The rotative ring 18 is turned so as to line up an indication arrow 24 with the time the bottle 14 is filled. This ring 18 is labeled with indicia 22 in increments to six hours and aligns with the time of filling indicia 22 on the stationary ring 16.

Figure 5:
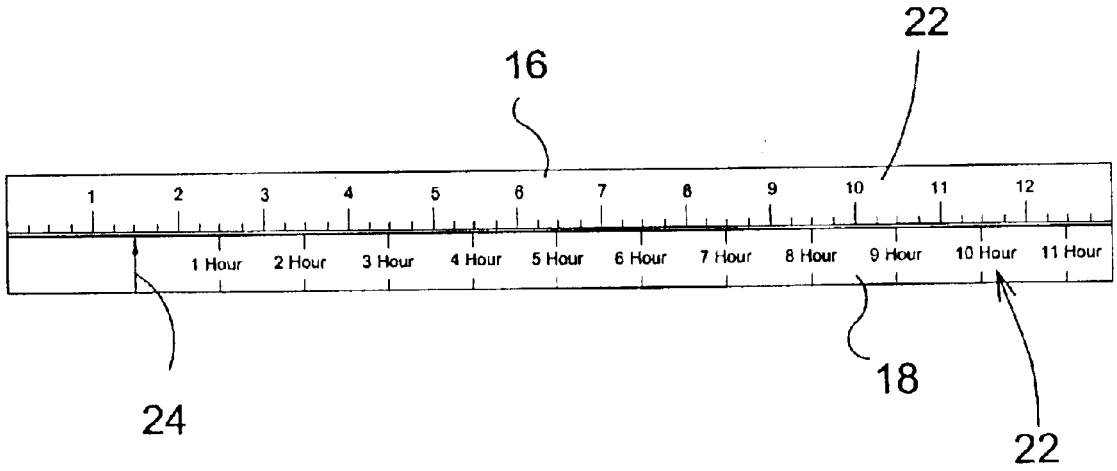
FIG. 5 is an illustrative view of the present invention.

Turning to FIG. 5, shown therein is an illustrative view of the present invention. Shown is an illustrative view of the present invention being an illustrated example which shows that the bottle was filled at 1:30 corresponding to the indication arrow 24 being lined up at 1:30. If the user looks at the indicia 22 on the bottle at 3:30, they can see the bottle is two hours old or at 4:00 the bottle would be two and a half hours old.

Figure 6:
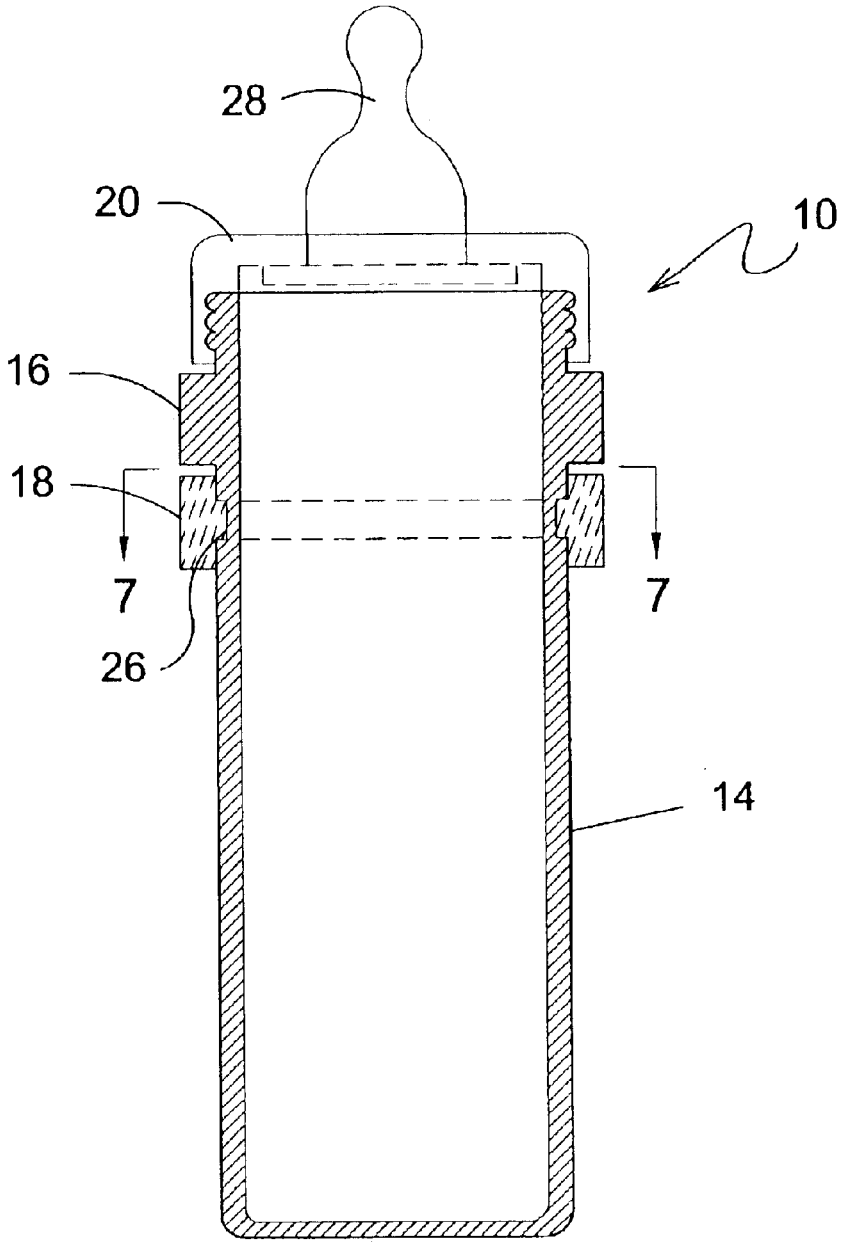
FIG. 6 is a sectional view of the present invention.

Turning to FIG. 6, shown therein is a sectional view of the present invention 10. Shown is a sectional view of the present invention 10 being a bottle 14 having cooperative rings 16, 18 positioned near the top portion of the bottle 14. The stationary hour ring 16 is labeled incrementally. The adjustable ring 18 is turned by being slidingly disposed in track 26 so as to line up an indication arrow with the time the bottle 14 is filled. This ring 18 is labeled in increments and aligns with the time of filling on the first fixed ring 16. An attachment ring 20 and nipple 28 are also shown.

Figure 7:
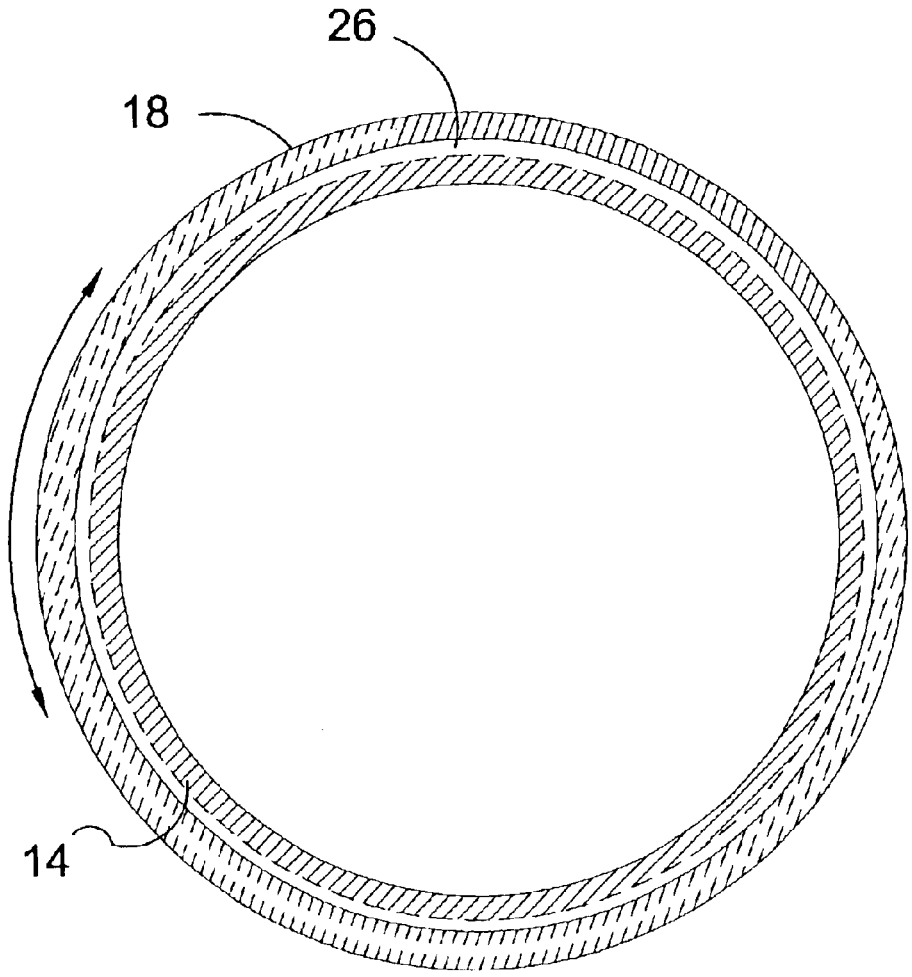
FIG. 7 is a cross sectional view of the present invention.

Turning to FIG. 7, shown therein is a cross sectional view of the present invention. Shown is a cross sectional view of the present invention, taken from FIG. 6 as indicated, showing the bottle 14 having a track 26 with a rotative ring 18 slidingly positioned therein whereby the ring has indicia thereon specifying a starting point and duration of time of similar graduations as the opposing ring whereby a user can determined the elapsed time since the contents of the bottle 14 were placed therein.

Figure 8:
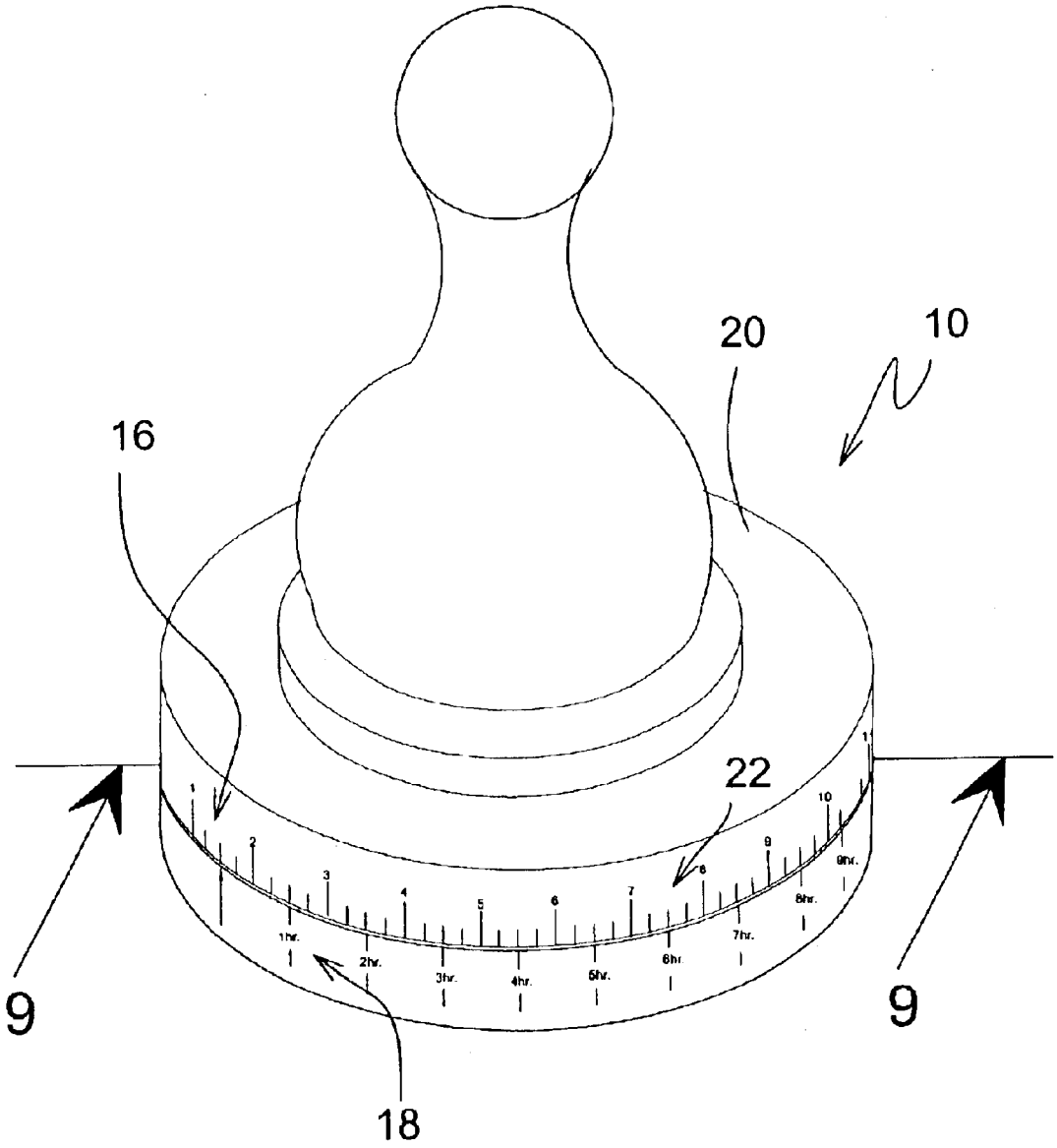
FIG. 8 is a perspective view of the present invention incorporated into a bottle cap.

Turning to FIG. 8, shown therein is a perspective view of the present invention 10 incorporated into a bottle cap 20. Shown is the present invention 10 incorporated into a bottle cap 20 with the stationary ring 16 with indicia 22 printed on the cap 20 with a rotative ring 18 having time duration printed thereon.

Figure 9:
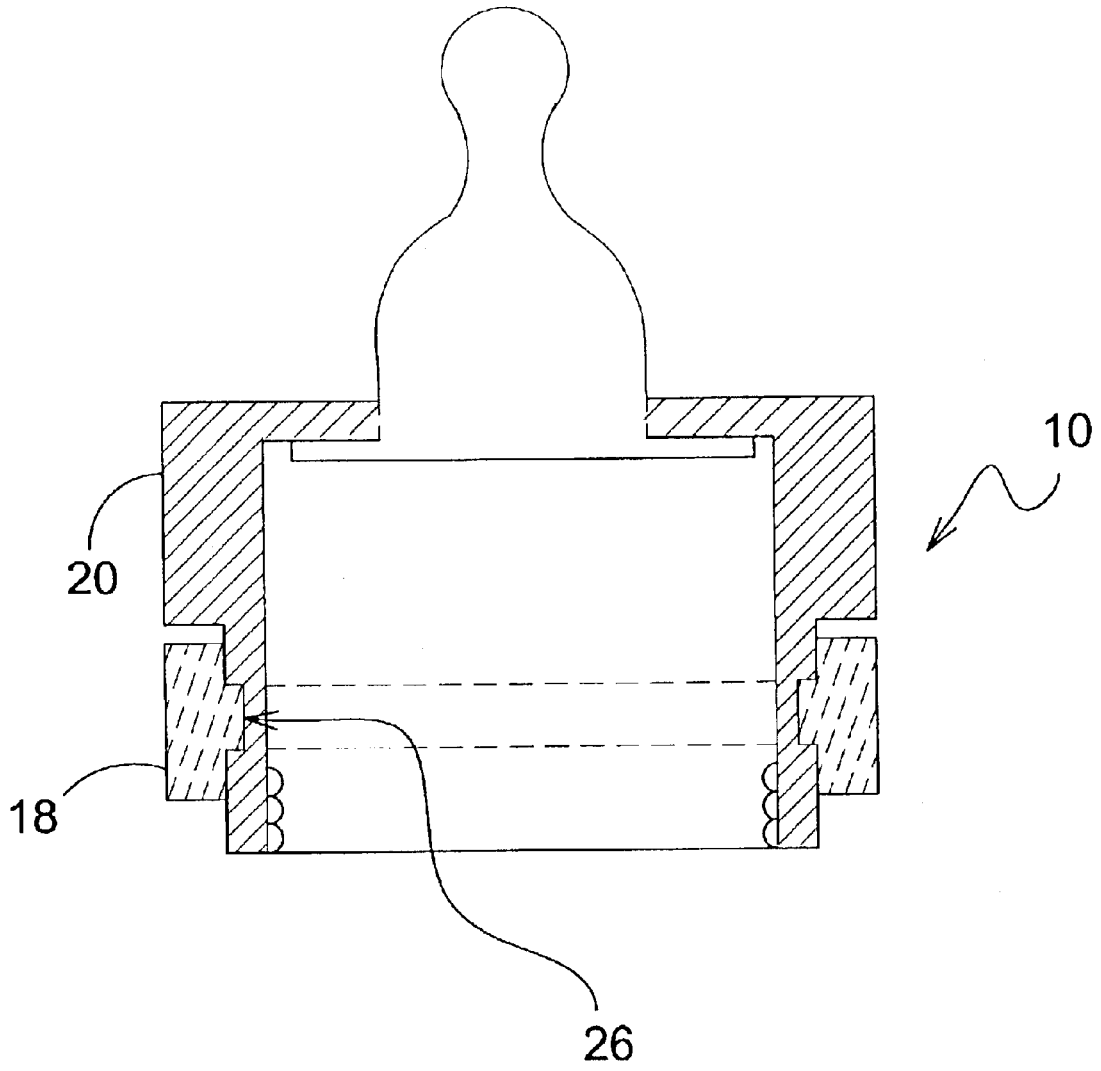
FIG. 9 is a cross sectional view of the present invention.

Turning to FIG. 9, shown therein is a cross sectional view of the present invention 10. Shown is a cross sectional view of the present invention 10, taken from FIG. 8 as indicated, showing the bottle cap 20 having a rotative ring 18 and track 26 forming an integral part therewith. Nipple 28 is also shown.

Figure 10:
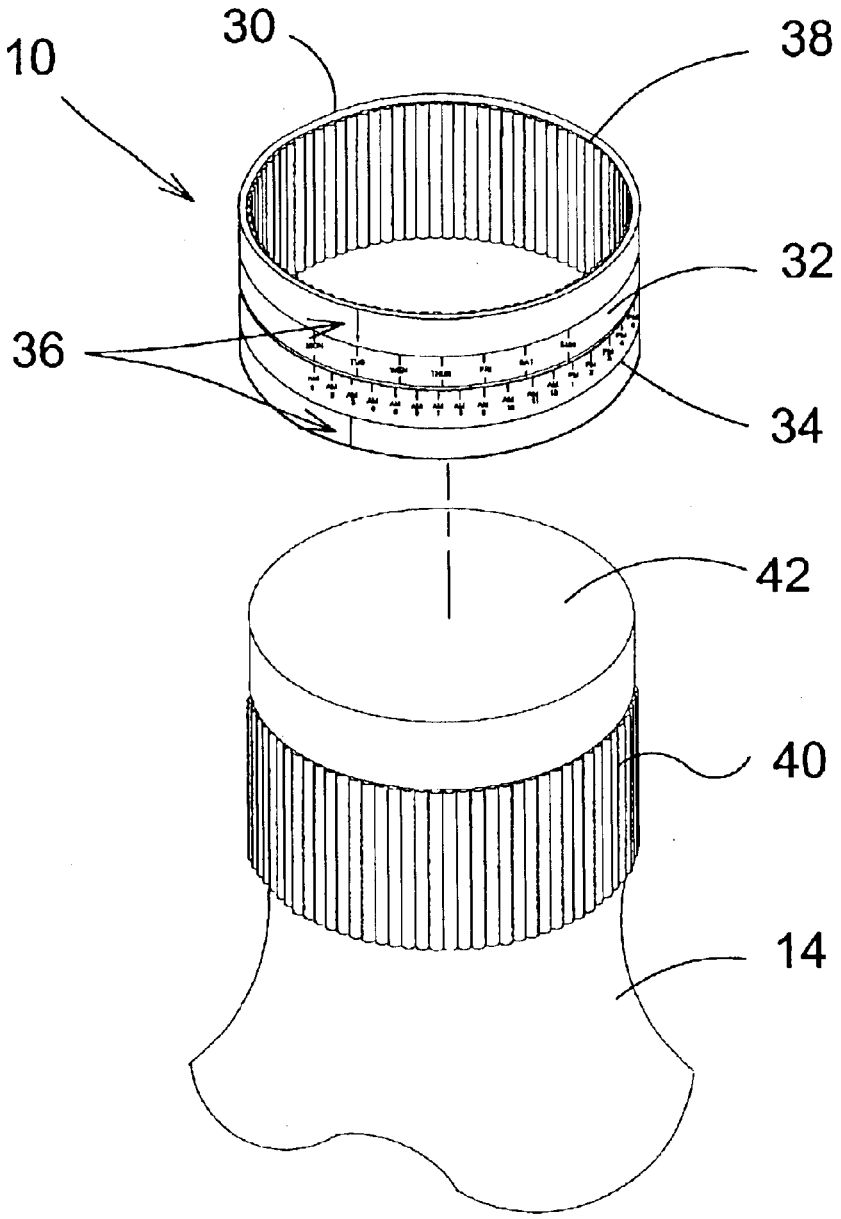
FIG. 10 is a perspective view of the present invention having an additional element.

Turning to FIG. 10, shown therein is a perspective view of the present invention 10 having an additional element. Shown is a perspective view of the present invention 10 incorporated into a collar 30 that can be fitted to an existing container 14. The collar 30 has upper and lower indicator lines 36 fixed across the stationary portion of the collar having rotative rings 32, 34 positioned therebetween. One ring 32 is labeled with days of the week while the other ring 34 is labeled in hours with smaller increments of time positioned between each hour. Each of the rings 32, 34 frictionally engages the collar to prevent random movement. To indicate the filling of the container 14 the day ring is rotated until the selected day is in alignment with the indicator line 36. The hour ring 34 is rotated until the predetermined hour or part thereof is in alignment with the previously determined day and indicator line 36. Collar 30 has multiple ridges 38 on its inner surface which mate to ridges 40 on the existing cap 42 of the bottle 14.

Figure 11:
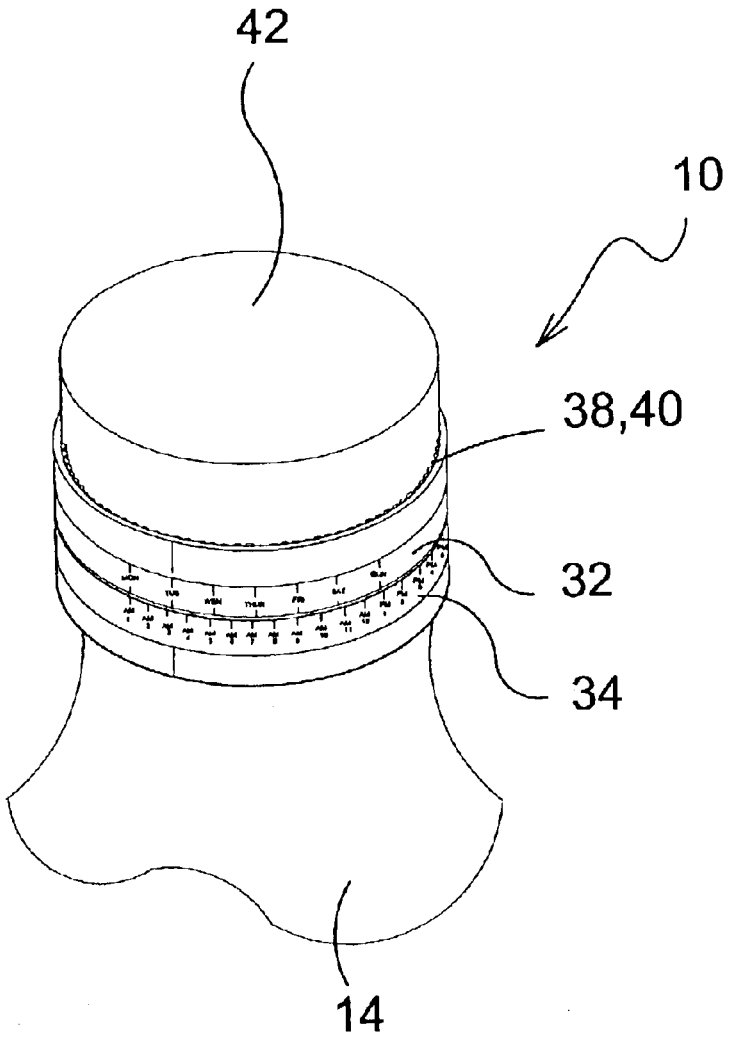
FIG. 11 is a perspective view of a bottle cap having the bottle timer thereon.

Turning to FIG. 11, shown therein is a perspective view of a bottle cap 42 having the bottle timer 10 thereon. Shown is a bottle cap 42 having the bottle cap timer 10 positioned thereon. The device can be used for opened bottles 14 to indicate when the container was opened. The device has rotative rings 32, 34 labeled in days of the week and hours in the day with smaller increments positioned therebetween. As depicted the day ring 32 has been rotated to indicate Tuesday while the hour ring 34 has been rotated to indicate 3:30 a.m. The ridges 38, 40 are also shown.

Figure 12:
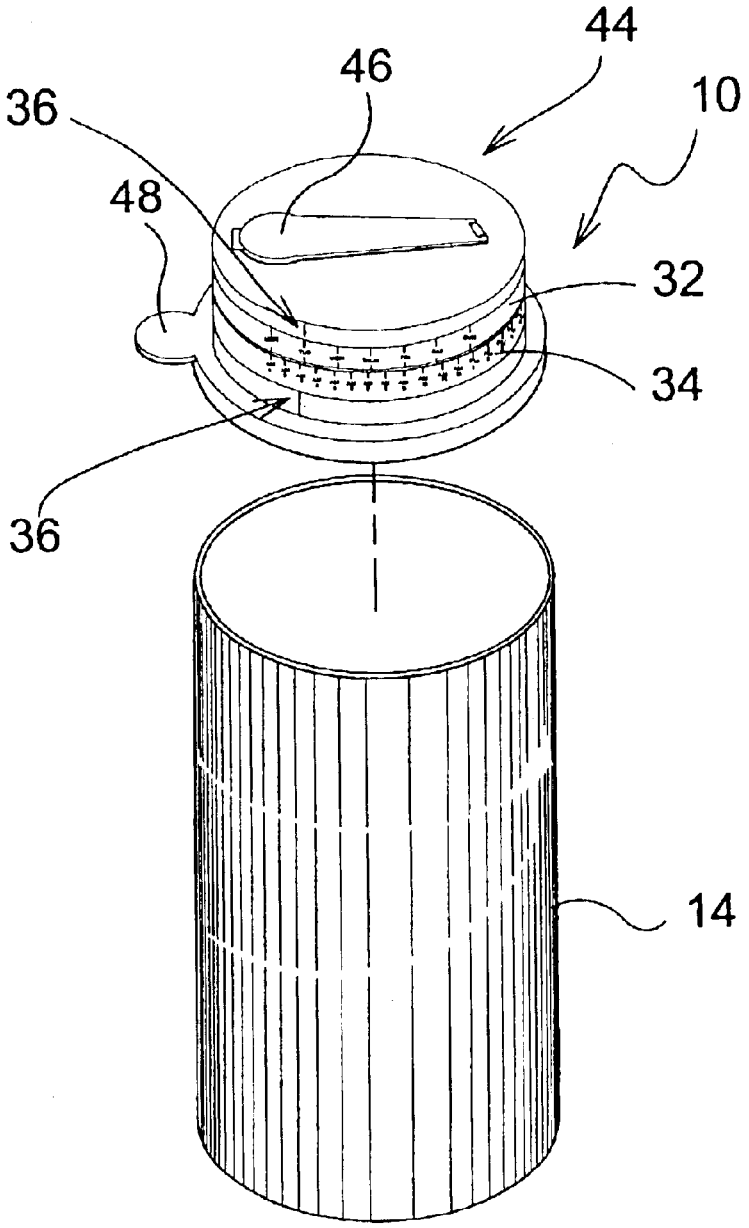
FIG. 12 is a perspective view of another additional element of the present

Turning to FIG. 12, shown therein is a perspective view of another additional element of the present invention 10. Shown is an additional element of the present invention 10 incorporated into a lid 44 to reseal opened containers 14. The device for open containers has a rotative day ring 32 labeled in days of the week which is rotated to align with an indicator mark 36. The hour ring 34 is rotated to line up with the previously selected day the container is opened to indicate time opened. The cap 44 also provides a pop open top spout 46 and a convenient lift tab 48.

Figure 13:
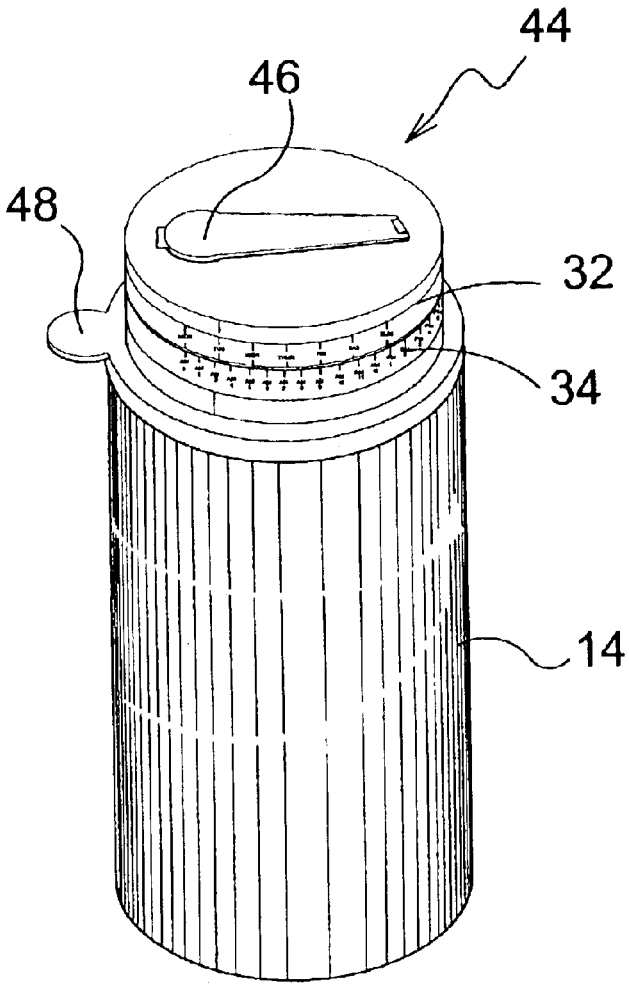
FIG. 13 is a perspective view of the installed bottle timer.

Turning to FIG. 13, shown therein is a perspective view of the installed bottle timer. Shown is the bottle timer incorporated into a resealable cap 44 placed on a container 14 having partially used contents whereby the resealable cover 44 has means for selectively setting a day and time of resealing the container 14. The device has a rotative day ring 32 labeled in days of the week and an hour ring 34 that is selectively rotatable so as to line up the hour with the day the container 14 is opened as previously disclosed. The cap 44 also provides a pop open spout 46 and a convenient lift tab 48.

Figure 14:
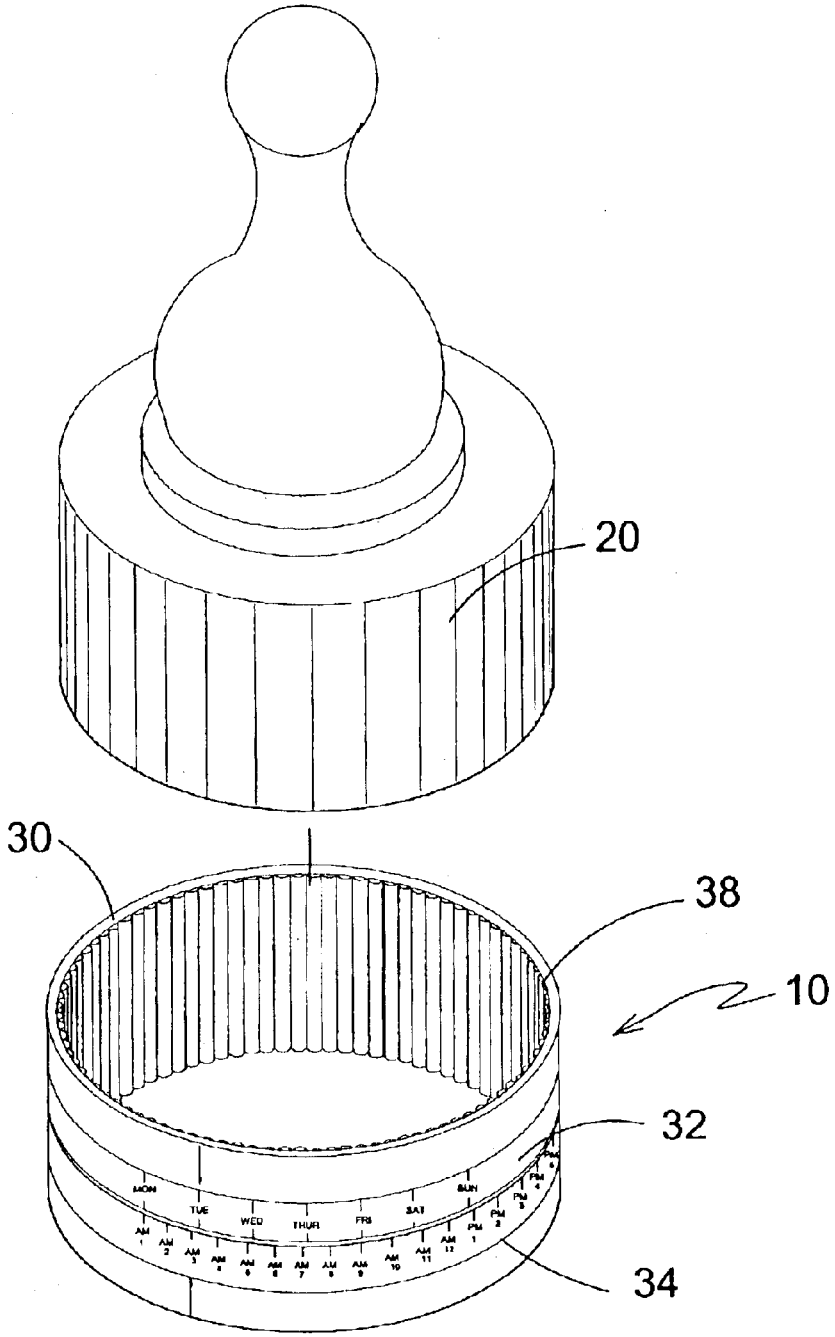
FIG. 14 is a perspective view of another additional element of the present invention.

Turning to FIG. 14, shown therein is a perspective view of another additional element of the present invention 10. Shown is another additional element of the present invention 10 in the form of a collar 30 having means for indicating a time of bottling. The collar 30 has a rotative ring labeled in days of the week 32 and a rotative hour ring 34 that is rotated to align with the previously selected day as previously disclosed. The device of the present invention can be adapted to a variety of different types of containers on the market. Also shown are cap 20 for receiving collar 30 shown along with ridges 38.

I claim:

1. A fluid container time indicator, comprising:

a) a fluid container having an upper portion and a lower portion, said fluid container having a wall which forms said fluid container, said wall having an outer surface;

b) a stationary ring disposed on said outer surface of said wall adjacent to said upper portion, said stationary ring encircling said fluid container in substantially the horizontal plane, wherein said stationary ring comprises first timing indicia corresponding to hours and portions of hours of a selected time cycle spaced apart equally along said stationary ring;

c) a track recess disposed on said outer surface of said wall adjacent to and below said stationary ring, said track recess encircling said fluid container in substantially the horizontal plane; and, d) a rotatable ring slidingly disposed in said track recess, wherein said rotatable ring comprises second timing indicia corresponding to hours and portions of hours of a selected time cycle spaced apart along said rotatable ring, wherein said rotatable ring comprises a zero time indication placed at the beginning of said second timing indicia to permit a user to determine the length of time which has passed since the fluid container was filled by placing the zero time indication of the rotatable ring at the first timing indicia corresponding to the actual time the fluid container was filled and then reading the length of time from the second timing indicia corresponding to the current actual time as road from the first timing indicia.

2. The fluid container of claim 1, wherein said first indicia are disposed on said rotatable ring and said second indicia are disposed on said stationary ring.

3. A cap having a time indicator thereon, the cap for attachment to a neck of a fluid container, comprising:

a) said cap having an upper portion and a lower portion, said cap having a wall which forms said cap, said wall having an outer and an inner surface, said lower portion having an opening therein, said opening for receiving a neck of a fluid container, said inner surface of said lower portion having threads for mating to a threaded neck of a fluid container;

b) a stationary ring disposed on said outer surface of said wall adjacent to said upper portion, said stationary ring encircling said cap in substantially the horizontal plane, wherein said stationary ring comprises first timing indicia corresponding to hours and portions of hours of a selected time cycle spaced apart equally along said stationary ring;

c) a track recess disposed on said outer surface of said wall adjacent to and below said stationary ring, said track recess encircling said cap in substantially the horizontal plane; and, d) a rotatable ring slidingly disposed in said track recess, wherein said rotatable ring comprises second timing indicia corresponding to hours and portions of hours of a selected time cycle spaced apart equally along said rotatable ring, wherein said rotatable ring comprises a zero time indication placed at the beginning of said second timing indicia to permit a user to determine the length of time which has passed since the fluid container on which said cap is disposed was filled by placing the zero time indication of the rotatable ring at the first timing Indicia corresponding to the actual time the fluid container was filed and then reading the length of time from the second timing indicia corresponding to the current actual time as read from the first timing indicia.

4. The cap of claim 3, wherein said first indicia are disposed on said rotatable rind and said second indicia are disposed on said stationary ring.

* * * * *